US011097912B2

(12) United States Patent
Clark et al.

(10) Patent No.: US 11,097,912 B2
(45) Date of Patent: Aug. 24, 2021

(54) TETHERED TRAILING EDGE MEDIA GUIDE

(71) Applicant: Xerox Corporation, Norwalk, CT (US)

(72) Inventors: Robert A. Clark, Williamson, NY (US); Brian R. Ford, Walworth, NY (US); Arthur H. Kahn, Wayland, NY (US)

(73) Assignee: Xerox Corporation, Norwalk, CT (US)

( * ) Notice: Subject to any disclaimer, the term of this patent is extended or adjusted under 35 U.S.C. 154(b) by 187 days.

(21) Appl. No.: 16/446,691

(22) Filed: Jun. 20, 2019

(65) Prior Publication Data

US 2020/0399083 A1 Dec. 24, 2020

(51) Int. Cl.

| | |
|---|---|
| ***B65H 3/54*** | (2006.01) |
| ***B65H 1/26*** | (2006.01) |
| *B65H 1/04* | (2006.01) |

(52) U.S. Cl.

CPC ..... *B65H 3/54* (2013.01); *B65H 1/266* (2013.01); *B65H 1/04* (2013.01); *B65H 2405/11164* (2013.01)

(58) Field of Classification Search

CPC . B65H 3/54; B65H 1/266; B65H 1/04; B65H 2405/11164; B65H 1/10; B65H 31/20; B65H 31/38; B65H 31/34; B65H 31/3081; Y10T 16/90; B43M 9/00; A47F 7/0014; B43L 5/022; Y10S 206/818

See application file for complete search history.

(56) References Cited

U.S. PATENT DOCUMENTS

| | | | | | |
|---|---|---|---|---|---|
| 1,396,436 | A | * | 11/1921 | Kately | B65H 31/40 271/222 |
| 1,567,182 | A | * | 12/1925 | Cheshire | B65H 3/56 271/167 |
| 2,070,903 | A | * | 2/1937 | Horst | B65H 3/54 271/104 |
| 2,621,807 | A | * | 12/1952 | Rendich | B23Q 16/001 269/54.5 |
| 4,054,284 | A | | 10/1977 | Kupisiewicz | |
| 4,275,878 | A | * | 6/1981 | Ruschepaul | B65H 1/04 271/170 |
| 4,556,211 | A | * | 12/1985 | Carr | B65H 31/38 271/221 |
| 5,738,454 | A | | 4/1998 | Zepeda et al. | |
| 5,923,942 | A | | 7/1999 | Nuggehalli et al. | |

(Continued)

FOREIGN PATENT DOCUMENTS

| | | | |
|---|---|---|---|
| CN | 1047566 | C | 12/1999 |
| JP | 3795858 | B2 | 7/2006 |

*Primary Examiner* — Gregory W Adams

(74) *Attorney, Agent, or Firm* — Gibb & Riley, LLC

(57) ABSTRACT

Printing devices include a printing engine and a media tray connected to a frame. The media tray is adapted to hold a stack of media supplied to the printing engine for printing. A magnetic trailing edge guide that is shaped to contact a corner of the stack of media is connected to a tether that is connected to the frame. A storage device is connected to the frame, and the storage device is shaped to accommodate the magnetic trailing edge guide. The length of the tether allows the magnetic trailing edge guide to reach the corner of the stack of media and to reach the storage device. The magnetic trailing edge guide includes a magnetic element adapted to magnetically hold to at least the media tray and the storage device.

20 Claims, 6 Drawing Sheets

(56) References Cited

U.S. PATENT DOCUMENTS

| | | | | |
|---|---|---|---|---|
| 5,957,447 | A | 9/1999 | Sekine | |
| 6,688,592 | B1 | 2/2004 | Tan et al. | |
| 6,845,976 | B2 * | 1/2005 | Martin | B65G 59/04 271/145 |
| 7,668,502 | B2 | 2/2010 | Park | |
| 7,770,877 | B2 | 8/2010 | Hasegawa | |
| 8,262,081 | B2 | 9/2012 | Ford et al. | |

* cited by examiner

TETHERED TRAILING EDGE MEDIA GUIDE

BACKGROUND

Devices herein generally relate to cut sheet supply devices, such as media trays, etc., and to paper guides of such devices.

Many sheet processing devices, such as bookmaking machines, binding machines, hole punch machines, trimming machines, printers, etc., receive cut sheets of media from a media storage unit that is often referred to as a paper tray or media tray. Such media trays often include one or more adjustable media guides that can be moved to be aligned with the edges of the stack of media and keep such stack edges aligned so that the side of the stack of media remains as a straight line that is approximately perpendicular to the surface of the media tray that contacts and supports the stack of media (sometimes referred to as the media-support surface of the media tray).

Keeping the sides of the stack of media aligned and straight helps the feed head grasp individual sheets when moving the sheets from the media tray to the sheet processing device. If the stack of media becomes misaligned (such that the edge of the stack no longer forms a straight line approximately perpendicular to the media-support surface of the media tray) the feed head may inadvertently feed multiple sheets at a time (instead of feeding a single sheet at a time) which is sometimes referred to as "multi-feed" situation, or a misaligned stack may cause the feed head to not properly contact the sheets and not feed sheets when desired. These types of media feed failures can cause multiple sheets to travel together through the sheet processing device (possibly causing paper jams) or cause sheets to be missing from the sheet flow, which can slow processing speeds and/or produce defective output that has missing pages or out-of-order pages, etc.

For example, adjustable media guides may be positionable only at predefined intervals within a predefined range of maximum to minimum size adjustments along the surface of the media tray that supports the stack of media. However, some sheets may not exactly match the media guide's predefined spacing intervals, or the size of the sheets may not fall within the predefined maximum to minimum size range within which the adjustable media guides are movable. Therefore, for some sized sheets the adjustable media guides may not maintain the alignment of the stack of sheets, which can result in misfeeds, paper jams, defective output, loss of productivity, etc.

SUMMARY

Exemplary devices herein, such as a printing device include (among other components) a frame, a printing engine connected to the frame, a media tray connected to the frame, etc., a magnetic trailing edge guide shaped to contact a corner of the stack of media, a tether having a first end connected to the magnetic trailing edge guide and a second end connected to the frame, a storage device for the magnetic trailing edge guide connected to the frame, etc. The media tray has a media-support surface that is adapted to hold a stack of media that is supplied to the printing engine for printing. The storage device is shaped to accommodate the magnetic trailing edge guide. Also, the length of the tether allows the magnetic trailing edge guide to reach the corner of the stack of media and to reach the storage device.

In some embodiments herein the media tray and the storage device can be made of (or include) ferromagnetic elements that attract and are attracted to magnets; and the magnetic trailing edge guide can include a magnetic element that is adapted to magnetically hold to (at least) the ferromagnetic elements of the media tray and the storage device.

Also, some of these devices can include a bias member that connects the second end of the tether to the frame. The bias member is positioned relative to the media tray to, and is adapted to, move the tether so as to exert bias force on the magnetic trailing edge guide in the direction from the corner of the stack of media toward an opposing end of the stack of media (the opposing end of the stack of media is opposite the corner of the stack of media). In other words, the bias member applies force to the tether that pulls the magnetic trailing edge guide against the side of the stack of media (toward the opposite end of the stack) to keep the stack of media straight and all the sheets aligned.

This "bias member" can include a retractor adapted to draw the tether into the bias member (and release the tether from the bias member) to change the amount of tether extending from the bias member. For example, the retractor can include a motor, or a spring-loaded device, each of which can be adapted to draw the tether into the bias member and release the tether from the bias member. The bias member and/or the tether itself can be made of an elastic material to avoid more complex motors or spring-loaded devices.

These and other features are described in, or are apparent from, the following detailed description.

BRIEF DESCRIPTION OF THE DRAWINGS

Various exemplary devices are described in detail below, with reference to the attached drawing figures, in which.

DETAILED DESCRIPTION

As mentioned above, some sheets may not exactly match the media guide's predefined spacing intervals, or the size of the sheets may not fall within the predefined maximum to minimum size range within which the adjustable media guides are movable. Therefore, for some sized sheets, the adjustable media guides may not maintain the alignment of the stack of sheets, which can result in misfeeds, paper jams, defective output, loss of productivity, etc.

In one example, some extra-long media may be longer than the media tray. To accommodate such extra-long media, the adjustable media guides can be removed, and a tray extension can be connected to the main media tray; however, such a tray extension often does not include any media guides which can result in media stack misalignment. Therefore, the devices herein provide a retractable trailing edge guide with a magnetic base. The retractable trailing edge guide is placed on the media stack trailing edge by the operator. The retractable trailing edge guide is sufficiently short so as to avoid interference with the tray frame when the tray is elevated to its highest position.

The trailing edge guide "floats" on top of the stack during feeder operation and is biased against the stack by a retractable tether. As sheets are fed out of the tray, the guide "floats" down to the tray base until the guide's magnetic base contacts the tray and adheres to it. When the tray is refilled, the operator can temporarily attach the trailing edge guide to a nearby frame member or dedicated storage element so that the trailing edge guide will not interfere with placing media into the tray. This provides trail edge control of the top sheets in the stack for any length sheet and any stack height due to the self-adjusting bias force provided by the tether. Further, the trailing edge guide can be easily temporarily removed and stowed to enable paper loading or use of other paper guides.

The tether prevents the trailing edge guide from being misplaced or dropped and provides the proper bias to keep the trailing edge guide on the sheet of media until the trailing edge guide magnetically attaches to the tray. The tether biases the leading edge of the sheets against the other side of the feed tray, ensuring that the sheets fully cover the feed head when acquired. This prevents vacuum leakage, which could potentially acquire other sheets below the acquired top sheet and cause a multi-feed.

When feeding shorter media, the retractor takes in the tether as the trailing edge guide is located on the stack, and maintains the force needed to bias the trailing edge guide against the stack so that the trailing edge guide remains in position as the stack is fed out of the feeder. As with the long media, the trailing edge guide eventually comes into contact with the tray, whereupon the magnetic base adheres to the tray.

Figure 1:
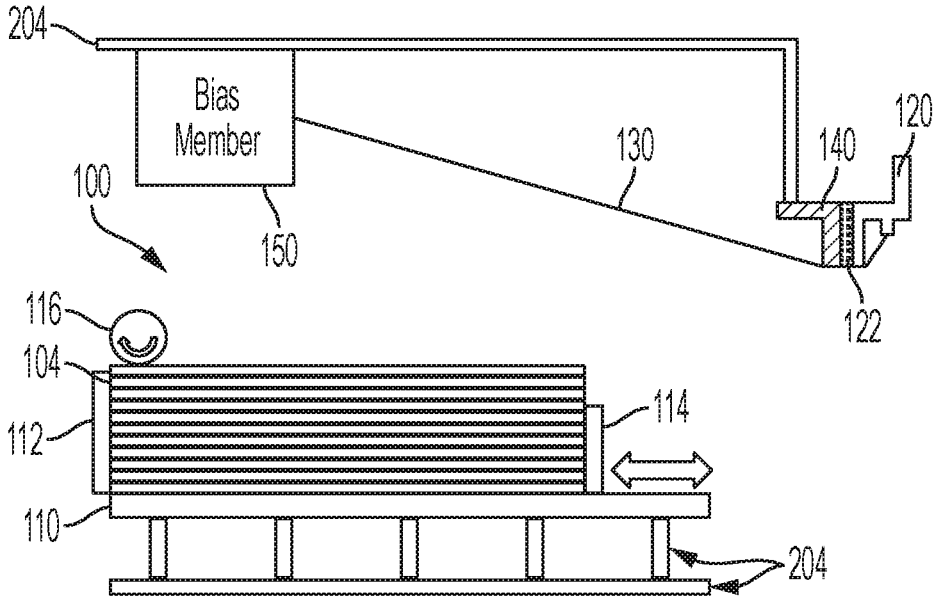
FIGS. 1-3 are schematic conceptual cross-sectional diagrams illustrating sheet supply devices herein.
Figure 6:
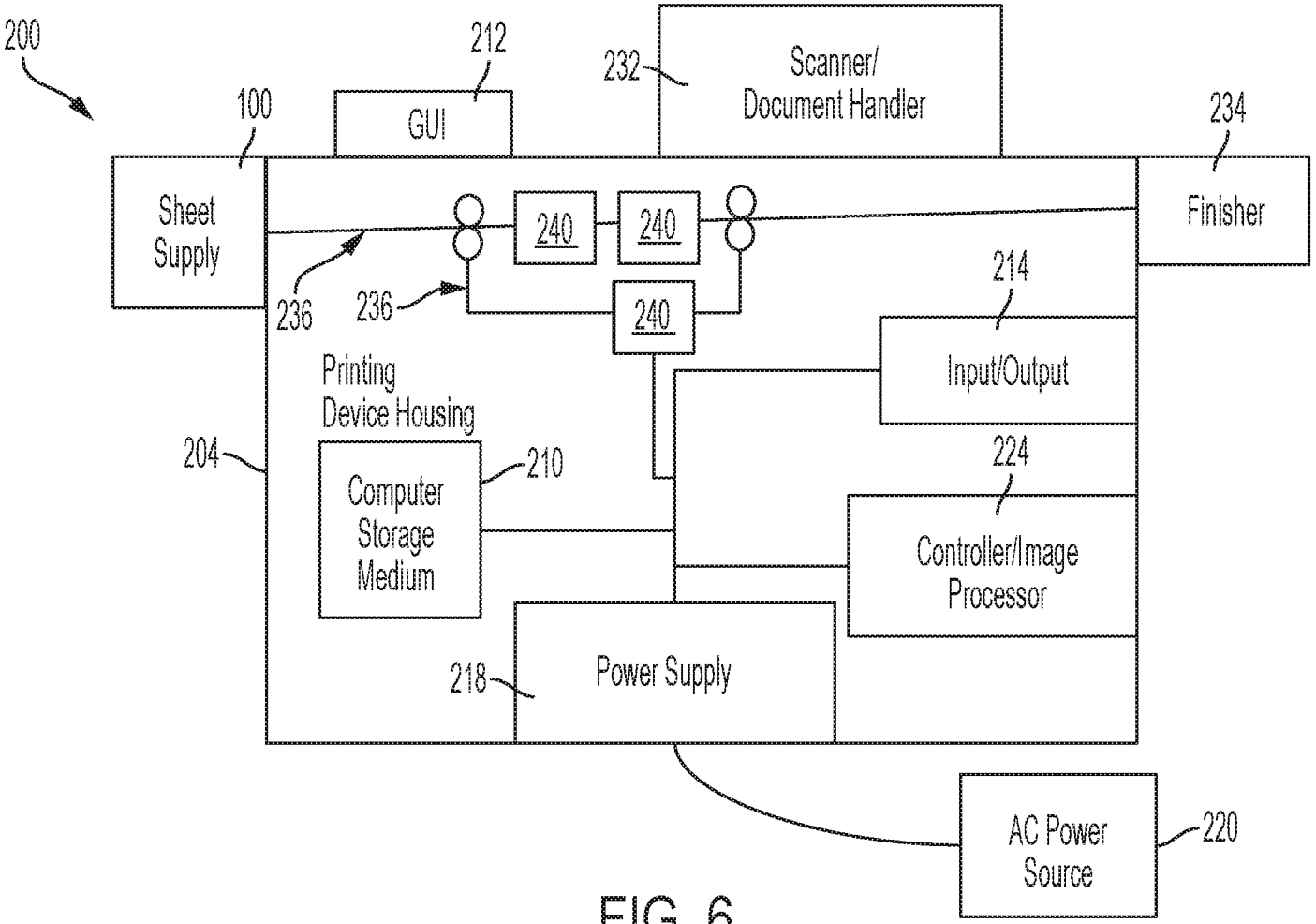
FIG. 6 is a schematic conceptual diagram illustrating printing devices herein.

FIGS. 1 and 7 are schematic (conceptual) diagrams showing one example of structures herein. As shown in FIGS. 1 and 6, devices herein, such as a printing device 200 (shown in FIG. 6 and discussed below) can include, among other components, a frame 204, a printing engine 240 (FIG. 6) connected to the frame 204 and a sheet supply 100 connected to the frame 204. While a printing engine 240 is used as an example of the sheet processing device, those ordinarily skilled in the art would understand that any form of sheet processing device (e.g., bookmaking machines, binding machines, hole punch machines, trimming machines, printers, etc.) could be used in place of the printing engine 240 and that item 240 represents all such sheet processing devices (whether currently known or developed in the future).

As shown in FIG. 1, the sheet supply 100 can include a media tray 110 having a media-support surface that is adapted to contact and support a stack of media 104 that is supplied to the printing engine 240 by a feed head 116 for printing. For example, a component of the feed head 116 can be a friction/vacuum roller or belt that contacts the top sheet and rotates to move the top sheet of media from the stack of media 104 to the printing engine 240.

As shown in FIG. 1, the media tray 110 can include alignment guides 112, 114 adapted to hold the stack of media 104 in place on the media-support surface of the media tray 110 to keep the sheets of media aligned with one another to maintain the alignment of the straight edge of the stack of media 104. One or more of such guides (e.g., guide 114) can be removable or adjustable as indicated by the double arrow in FIG. 1.

FIG. 1 also illustrates a magnetic trailing edge guide 120 shaped to contact a corner of the stack of media 104 and a tether 130 having a first end connected to the magnetic trailing edge guide 120 and a second end directly or indirectly connected to the frame 204. In one example, some embodiments herein can include a bias member 150 that connects the second end of the tether 130 to the frame 204. FIG. 1 also illustrates an optional dedicated storage device 140 for the magnetic trailing edge guide 120 and, as shown, the storage device 140 is connected to the frame 204. The storage device 140 is shaped to accommodate the magnetic trailing edge guide 120.

In some embodiments herein the media tray 110 and the storage device 140 can be made of one or more materials that are attracted to magnets (e.g., ferromagnetic materials, such as iron, nickel cobalt, alloys of rare-earth metals, etc.). Further, the magnetic trailing edge guide 120 can be made of magnetic material or can include a magnetic element 122 that is adapted to magnetically hold to (at least) the ferromagnetic elements of the media tray 110 and the storage device 140. Thus, as shown in FIG. 1, the magnetic fields produced by the magnetic trailing edge guide 120 (or magnetic element 122) hold the magnetic trailing edge guide 120 against the storage device 140 once the magnetic trailing edge guide 120 is placed in contact with or in close proximity to the storage device 140.

Figure 2A:
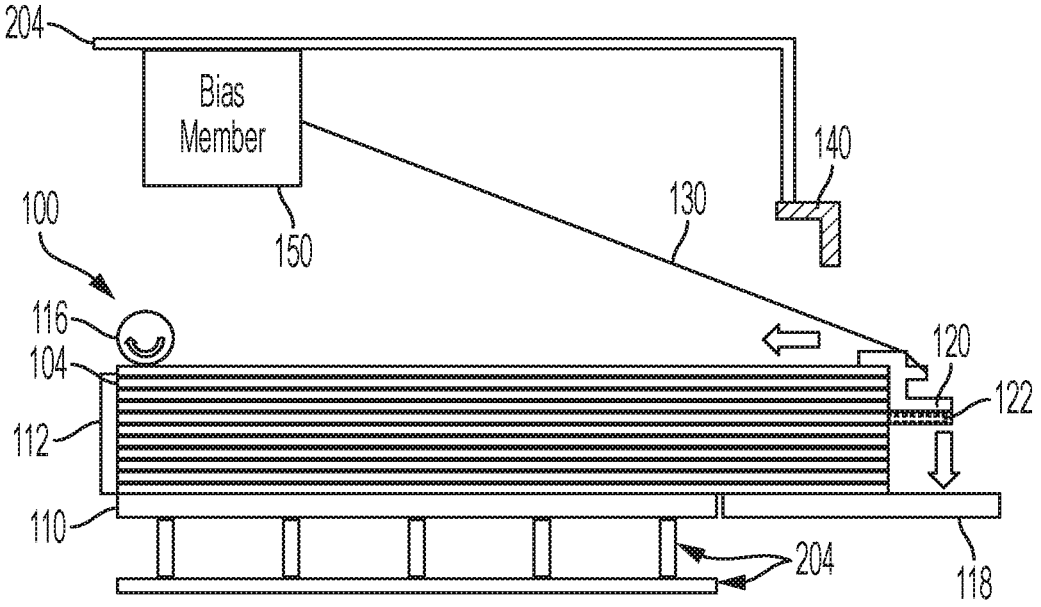

As noted above, sometimes the media tray 110 is not long enough to accommodate longer sheets of media. Therefore, the paper feeder 100 is adapted to allow one of the alignment guides 114 to be removed and for a tray extension 118 to be attached (e.g., attached to the frame 204 or the main media tray 110) as shown in FIG. 2A. However, with the alignment guide 114 no longer in place, the stack of media 104 can become misaligned, possibly affecting the operation of the feed head 116, resulting in multi-feeds, misfeeds, missing sheets, etc.

In order to address such issues, the magnetic trailing edge guide 120 can be manually moved from the storage device 140 to a corner of the stack of media 104 that is furthest away from (distal to) the feed head 116 (e.g., the trailing edge of the sheets of media) to keep the sheets aligned. Note that FIGS. 1 and 2A show that the length of the tether 130 allows the magnetic trailing edge guide 120 to reach both the corner of the stack of media 104 and to the storage device 140; however, the length of the tether 130 can be restricted so that the magnetic trailing edge guide 120 cannot be dropped on the floor, or placed in other areas that could cause machine malfunction.

As shown in FIG. 2A, an optional bias member 150 can be positioned, relative to the media tray 110, and can be connected to the tether in a manner so as to (the bias member 150 is adapted to) move or bias the tether 130 so as to exert bias force on the magnetic trailing edge guide 120 in the direction from the distal corner of the stack of media 104 that the magnetic trailing edge guide 120 contacts toward an opposing end of the stack of media 104 (e.g., biased toward the leading edge of the sheets of media that are adjacent the feed head 116). More specifically, the opposing end of the stack of media 104 is opposite the corner of the stack of media 104 that the magnetic trailing edge guide 120 contacts and is where the stack of media 104 contacts the other media guide 112.

Thus, the block arrows in FIG. 2A show that the weight of the magnetic trailing edge guide 120 (through gravitational force) pulls the magnetic trailing edge guide 120 downward toward the media tray 110 while the force exerted by the tether 130 pulls the magnetic trailing edge guide 120 horizontally toward the opposite corner of the stack of media 104 to keep the magnetic trailing edge guide 120 pushing downward (toward the media tray 110) and sideways against the side of the stack of media 104, and this keeps the magnetic trailing edge guide 120 pressing against the two sides (horizontal and vertical sides) of the corner of the stack of media 104. Those ordinarily skilled in the art would understand that, in this description, the downward direction is the same as the gravitational force (e.g., is a vertical direction) while horizontal directions are approximately perpendicular to the downward direction. In other words, the bias member 150 applies force to the tether 130 that pulls the magnetic trailing edge guide 120 horizontally against the side of the stack of media 104 (toward the opposite end of the stack) to keep the stack of media 104 pressed against the other media guide 112 to keep the sheets straight and aligned.

Figure 2B:
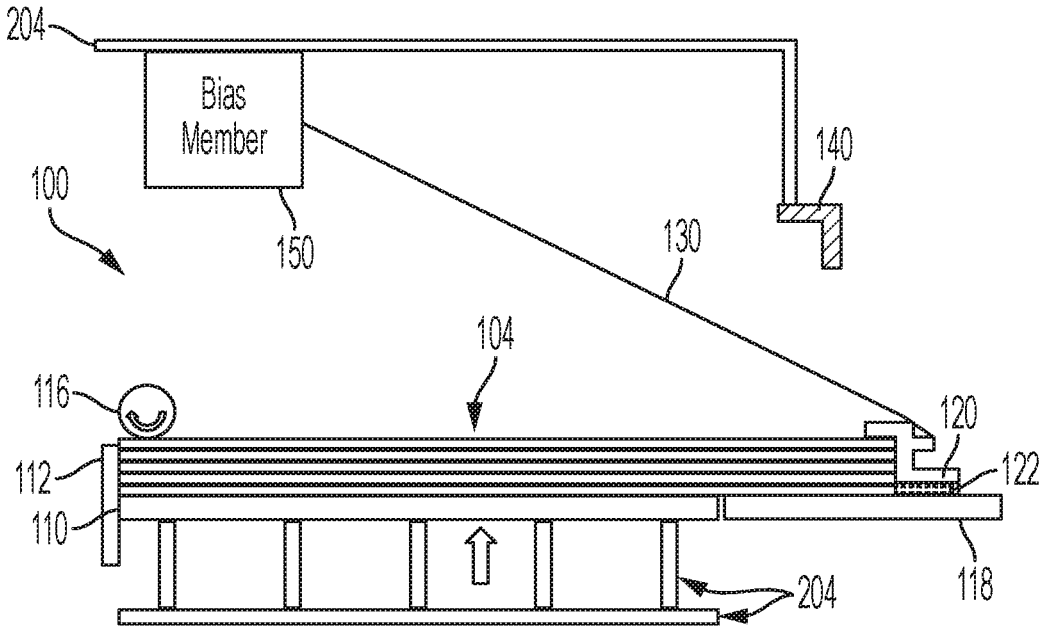

FIG. 2B illustrates that the magnetic trailing edge guide 120 moves (or "floats) downward toward the media tray 110 as sheets are removed from the stack of media 104 by the feed head 116 (e.g., the magnetic trailing edge guide 120 floats down to the media tray). Note that the media tray 110 can move upward toward the feed head 116 to keep sheets in contact with the feed head 116 and allow sheets to clear the edge of the other alignment guide 112 (potentially using spring loaded or motorized portions of the frame 204, or other mechanisms) as the height of the stack of media 104 decreases. Note that magnetic field forces between the magnetic trailing edge guide 120 and the media tray 110 may add to the gravitational forces biasing the magnetic trailing edge guide 120 toward the media tray 110.

Figure 2C:
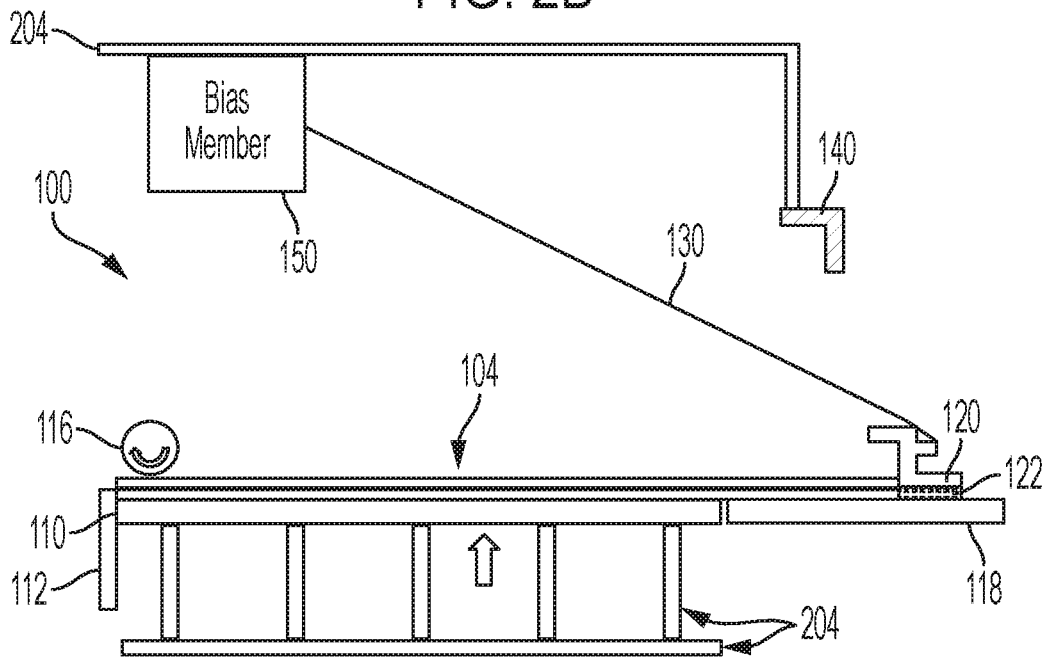

At some point, the magnetic trailing edge guide 120 will contact the media tray 110 (as shown in FIG. 2B) and the magnetic nature of the magnetic trailing edge guide 120 (or the magnetic element 122) magnetically attaches to the media tray 110. Thus, as shown in FIG. 2C, even when the last sheets of the stack of media 104 remain, the magnetic trailing edge guide 120 is kept in place and does not move, roll, or slide along the media tray 110 because the magnetic bond between the magnetic trailing edge guide 120 and the media tray 110 keeps the magnetic trailing edge guide 120 in place on the media-supporting surface of the media tray 110.

Figure 2D:
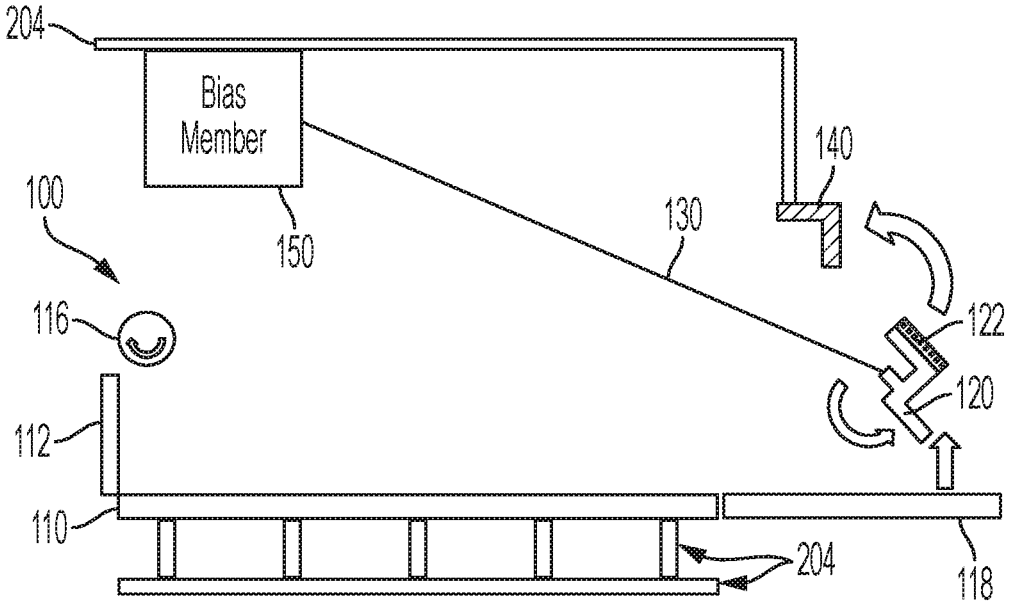
Figure 2E:
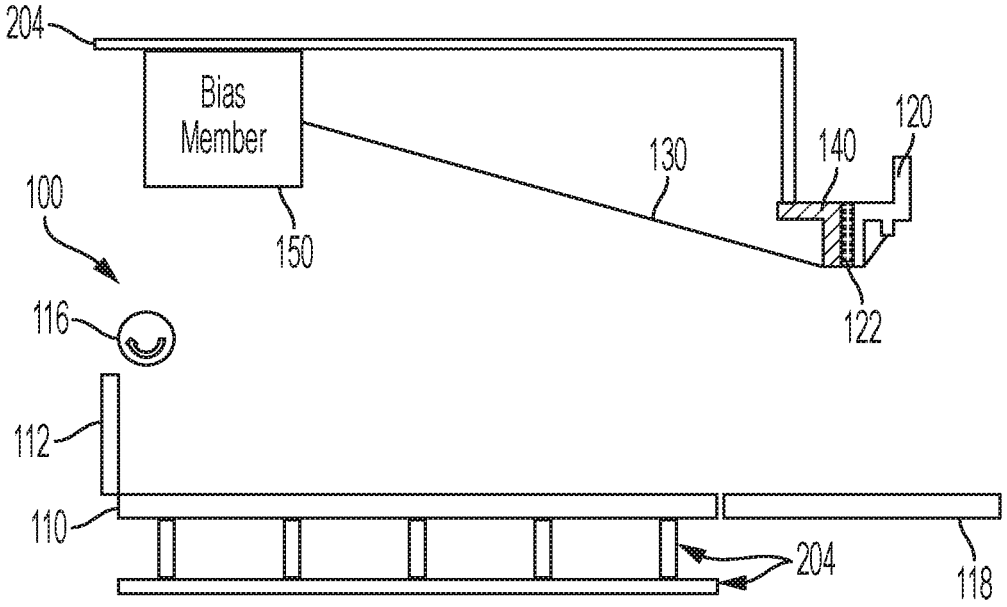

As shown by the arrows in FIG. 2D, the magnetic trailing edge guide 120 can be manually stored on the storage device 140 by being moved upward away from the media tray 110 (breaking the magnetic bond between the magnetic trailing edge guide 120 and the media tray 110) and by being rotated and placed against the storage device 140. FIG. 2E shows the magnetic trailing edge guide 120 after being manually moved to, and magnetically attached to, the storage device 140.

Figure 3:
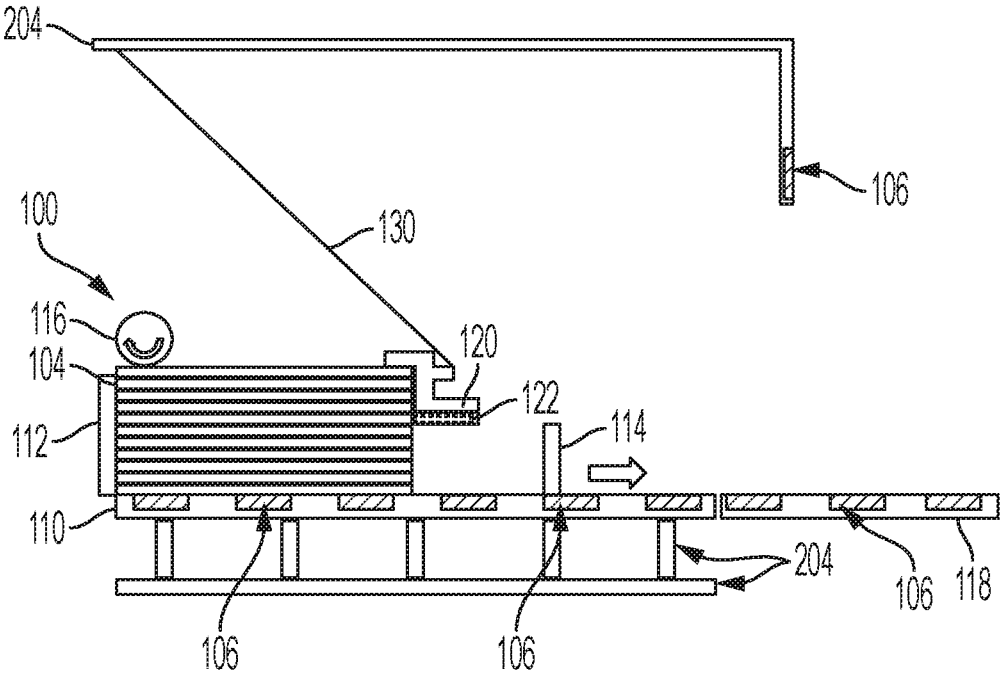

FIG. 3 illustrates different options for the structures discussed above. FIG. 3 also illustrates that the magnetic trailing edge guide 120 can be used to maintain the alignment of extra short sheets where, for example, the alignment guides 114 may not be able to be adjusted small enough to rest against such a stack of very short sheets.

In one option shown in FIG. 3, the storage device 140 can be omitted and instead a magnetically attracted element 106 (e.g., ferromagnetic materials, etc.) can be included within or on the frame 204, or the frame 204 can be made of a ferromagnetic material (e.g., steel). For example, if the frame 204 has at least portions that are a ferromagnetic material, one of the ferromagnetic areas of the frame 204 can be labeled as an appropriate location for the magnetic trailing edge guide 120 to be attached.

Specifically, by providing appropriate signage (e.g., "attach trailing edge guide here for storage," etc.) and/or distinctive coloring (red, yellow, orange, etc.) of a frame 204 location, the user can be encouraged to magnetically attach the magnetic trailing edge guide 120 to the frame 204, thereby keeping the magnetic trailing edge guide 120 out of the way while media is being loaded or when other media guides (e.g., 114) are being used. Therefore, with the structure shown in FIG. 3, the magnetic trailing edge guide 120 can be stored by being magnetically attached to the frame 204 (or the magnetically attractive element 106 within the frame 204), without using the dedicated storage device 140 discussed above.

As noted above, the media tray 110 can be formed of any material that is attracted to magnets; however, as shown in FIG. 3, if the media tray 110 is not formed of a material that is attracted to/by magnets, magnetically attractive elements 106 can be attached to or included within the media tray 110 (and potentially within the tray extension 118).

In another option shown in FIG. 3, the bias member 150 can be omitted and instead the tether 130 itself can be made of an elastic material (polymer materials with high elastic nature) that gains bias as it is made longer and exerts this bias until it becomes short again. Therefore, as shown in FIG. 3, an elastic tether 130 can be directly to the frame 204 and the magnetic trailing edge guide 120 without other intervening components. Using just an elastic tether 130 can avoid a more complex motor or spring-loaded device.

Figure 4:
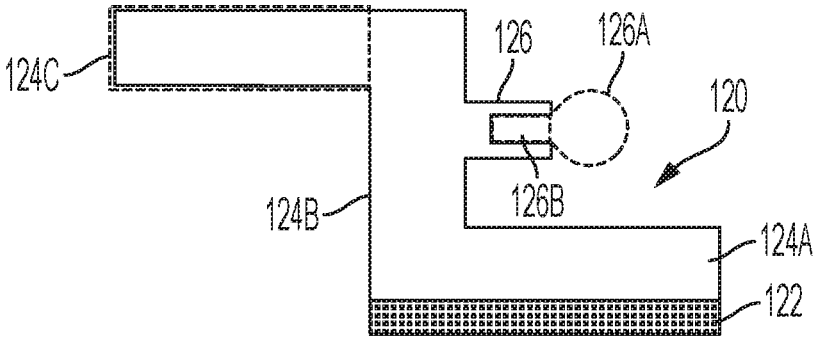
FIG. 4 is a schematic conceptual cross-sectional diagram illustrating a magnetic trailing edge guide herein.

FIG. 4 illustrates the magnetic trailing edge guide 120 in greater detail. As can be seen in FIG. 4, the magnetic trailing edge guide 120 can include some parallel elements 124A, 124C that are connected by a perpendicular element 124B. The perpendicular element 124B may be approximately (e.g., within 5%, 10%, 15%, etc. of) perpendicular to the parallel elements 124A, 124C. Further, magnetic trailing edge guide 120 elements 124A-124C may be separate elements or merely portions of a unitary unbroken structure.

Additionally, some of these elements 124A-124C can be omitted where, for example, the broken-line surrounding element 124C indicates that this element may be omitted for some structures. Therefore, in cross-section or side view, the magnetic trailing edge guide 120 can be described as having an L-shape, a double inverted-L shape, a truncated or partial I-beam shape, a square Z-shape, square S-shape, etc., by having approximately parallel members extending in opposite directions from (and from opposite ends of) an intervening approximately perpendicular member.

FIG. 4 also illustrates a tether connection point 126. The tether connection point 126 can be a loop or hook 126A (shown using broken lines to indicate such being an option) to which the tether 130 can be tied or hooked. In other alternatives, the tether connection point 126 can be an element with a threaded or unthreaded recess 126B (shown using broken lines to indicate such being an option) into which a fastener (such as a screw, rivet, etc.) can be used to connect the tether 130. Additionally, the tether connection point 126 can be a flat bonding surface (e.g., see FIGS. 1-3) to which the tether 130 can be glued, welded, soldered, bonded, etc., such that the connection point 126 is adapted to firmly connect the tether 130 and the magnetic trailing edge guide 120.

Figure 5A:
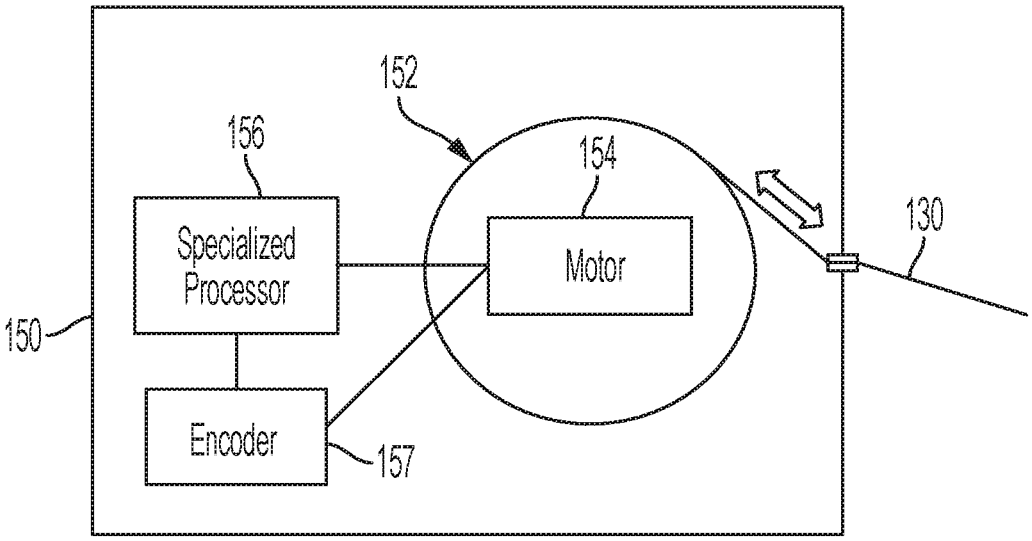
FIGS. 5A-5B are schematic conceptual cross-sectional diagrams illustrating bias members herein.
Figure 5B:
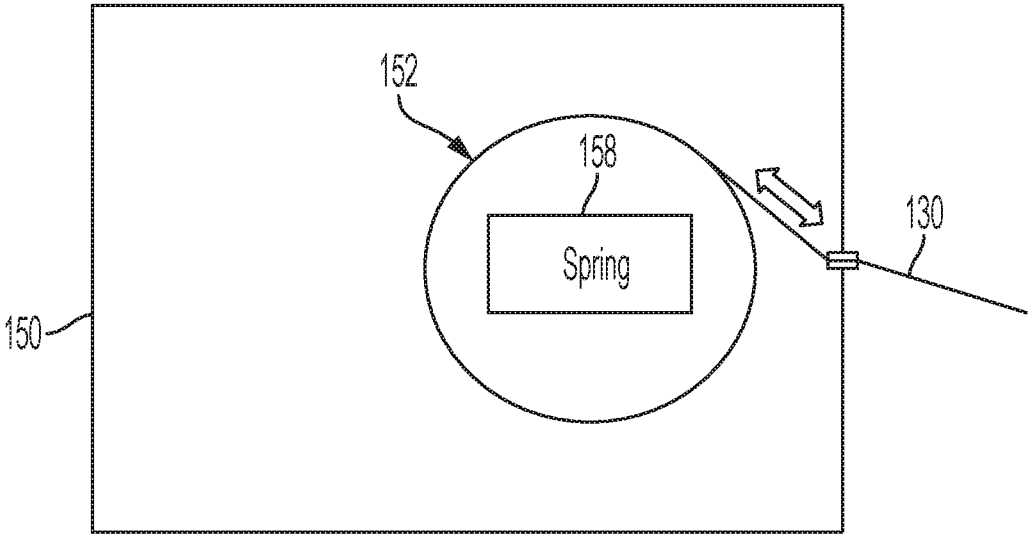

As shown in FIGS. 5A and 5B, the bias member 150 can include a retractor 152 (e.g., spool, bobbin, reel, etc.) adapted to draw-in or reel-in the tether 130 into the bias member 150 (and controllably release the tether 130 from the bias member 150) to change the amount of tether 130 extending from the bias member 150. For example, the retractor 152 can be rotated using a motor 154 (FIG. 5A), or a spring-loaded device 158 (FIG. 5B), each of which can be adapted to draw the tether 130 into the bias member 150 and release the tether 130 from the bias member 150.

The spring-loaded 158 retractor 152 (or the elastic tether 130 discussed above) have specific elastic material characteristics that cause them to automatically provide constant (e.g., the same, unchanging) bias force (tension) to the tether 130 and magnetic trailing edge guide 120. Similarly, the motor 154 driven retractor 152 can provide constant tension to a tether 130 that is not (or is much less) elastic.

Also, a specialized processor 156 can be included only in the bias member 150. Such a specialized processor 156 can dynamically change the amount of bias force or tension that is constantly placed on the tether 130 for different stacks of media 104 depending upon the type or weight of media within the stack of media 104, the height of the stack of media 104, the length of the media within the stack of media 104, the speed at which the feed head 116 moves the sheets, the weight of the magnetic trailing edge guide 120, the magnetic force of the magnetic or magnetically attractive elements 106, 122, etc. Further, the specialized processor 156 can dynamically change the amount of bias force or tension that is placed on the tether 130 based on how many sheets of media are in the stack of media 104 to optimize the ability of the trailing edge guide to remain in proper position on the corner of the stack of media 104.

Thus, the specialized processor 156 can be used only for determining the amount of tension that the tether 130 should be under, and inputs for determining such amount of tension can be received from sensors in the media tray 110, from the general processor 224 of the printer 204 (FIG. 6) which maintains the type, weight, size, etc., of the media, the speed of the feed head 116, details of the structure of the magnetic trailing edge guide 120 (e.g., weight, size, magnetic strength, etc.), etc. An encoder 157 can also be used to determine the length of the tether after the trailing edge guide is placed on the stack of media 110. This measured length can also be used by the specialized processor 156 to set the tether tension supplied by the motor 154, and also communicated back to the controller/image processor 224 to determine the length of media currently in media tray 110 (and tray extension 118, if it is used). Thus, the specialized processor 156 can provide sufficient tension on the tether 130 to keep the magnetic trailing edge guide 120 on the corner of the stack of media 104 (without pulling the magnetic trailing edge guide 120 off the stack of media 104 or off the media tray 110) and to provide sufficient tension to keep the stack of media 104 aligned.

FIG. 6 illustrates many components of sheet processing structures 200 herein that can comprise, for example, a printer, copier, multi-function machine, multi-function device (MFD), etc. The printing device 200 includes a controller/tangible processor 224 and a communications port (input/output) 214 operatively connected to the tangible processor 224 and to a computerized network external to the printing device 200. Also, the printing device 200 can include at least one accessory functional component, such as a graphical user interface (GUI) assembly 212. The user may receive messages, instructions, and menu options from, and enter instructions through, the graphical user interface or control panel 212.

The input/output device 214 is used for communications to and from the printing device 200 and comprises a wired device or wireless device (of any form, whether currently known or developed in the future). The tangible processor 224 controls the various actions of the printing device 200. A non-transitory, tangible, computer storage medium device 210 (which can be optical, magnetic, capacitor based, etc., and is different from a transitory signal) is readable by the tangible processor 224 and stores instructions that the tangible processor 224 executes to allow the computerized device to perform its various functions, such as those described herein. Thus, as shown in FIG. 6, a body housing has one or more functional components that operate on power supplied from an alternating current (AC) source 220 by the power supply 218. The power supply 218 can comprise a common power conversion unit, power storage element (e.g., a battery, etc.), etc.

The printing device 200 includes at least one marking device (printing engine(s)) 240 that use marking material, and are operatively connected to a specialized image processor 224 (that is different from a general purpose computer because it is specialized for processing image data), a media path 236 positioned to supply continuous media or sheets of media from a sheet supply 100 to the marking device(s) 240, etc. After receiving various markings from the printing engine(s) 240, the sheets of media can optionally pass to a finisher 234 which can fold, staple, sort, etc., the various printed sheets. Also, the printing device 200 can include at least one accessory functional component (such as a scanner/document handler 232 (automatic document feeder (ADF)), etc.) that also operate on the power supplied from the external power source 220 (through the power supply 218).

The one or more printing engines 240 are intended to illustrate any marking device that applies marking material (toner, inks, plastics, organic material, etc.) to continuous media, sheets of media, fixed platforms, etc., in two- or three-dimensional printing processes, whether currently known or developed in the future. The printing engines 240 can include, for example, devices that use electrostatic toner printers, inkjet printheads, contact printheads, three-dimensional printers, etc. The one or more printing engines 240 can include, for example, devices that use a photoreceptor belt or an intermediate transfer belt or devices that print directly to print media (e.g., inkjet printers, ribbon-based contact printers, etc.).

While some exemplary structures are illustrated in the attached drawings, those ordinarily skilled in the art would understand that the drawings are simplified schematic illustrations and that the claims presented below encompass many more features that are not illustrated (or potentially many less) but that are commonly utilized with such devices and systems. Therefore, Applicants do not intend for the claims presented below to be limited by the attached drawings, but instead the attached drawings are merely provided to illustrate a few ways in which the claimed features can be implemented.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known and are not described in detail herein to keep this disclosure focused on the salient features presented. The devices herein can encompass devices that print in color, monochrome, or handle color or monochrome image data. All foregoing devices are specifically applicable to electrostatographic and/or xerographic machines and/or processes.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). For reference, the term "approximately" herein means within a close percentage (e.g., 5%, 10%, 15%, etc.) of an exact number or relationship, where for example approximately perpendicular or parallel means within 5%, 10%, 15%, etc., of exactly perpendicular or parallel.

Further, the terms automated or automatically mean that once a process is started (by a machine or a user), one or more machines perform the process without further input from any user. Additionally, terms such as "adapted to" mean that a device is specifically designed to have specialized internal or external components that automatically perform a specific operation or function at a specific point in the processing described herein, where such specialized components are physically shaped and positioned to perform the specified operation/function at the processing point indicated herein (potentially without any operator input or action). In the drawings herein, the same identification numeral identifies the same or similar item.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. Unless specifically defined in a specific claim itself, steps or components of the devices herein cannot be implied or imported from any above example as limitations to any particular order, number, position, size, shape, angle, color, or material.

What is claimed is:

1. A media stack guide comprising:

a magnetic trailing edge guide shaped to contact a corner of a stack of media;

a tether connected to the magnetic trailing edge guide; and a storage device shaped to accommodate the magnetic trailing edge guide, wherein a length of the tether allows the magnetic trailing edge guide to reach the corner of the stack of media and to reach the storage device.

2. The media stack guide according to claim 1, further comprising a bias member connected to the tether.

3. The media stack guide according to claim 2, wherein the bias member is positioned and adapted to move the tether to exert bias force on the magnetic trailing edge guide in a direction from the corner of the stack of media toward an opposing end of the stack of media, and wherein the opposing end of the stack of media is opposite the corner of the stack of media.

4. The media stack guide according to claim 2, wherein the bias member comprises a retractor adapted to draw the tether into the bias member and release the tether from the bias member to change an amount of the tether extending from the bias member.

5. The media stack guide according to claim 4, wherein the retractor comprises a motor or a spring-loaded device adapted to draw the tether into the bias member and release the tether from the bias member.

6. The media stack guide according to claim 2, wherein the bias member comprises an elastic material.

7. A media stack guide comprising:

a trailing edge guide shaped to contact a corner of a stack of media; and a tether connected to the trailing edge guide;

wherein a length of the tether allows the trailing edge guide to reach the corner of the stack of media, and wherein the tether comprises an elastic material.

8. A media stack guide comprising:

a magnetic trailing edge guide shaped to contact a corner of a stack of media positioned on a media tray;

a tether connected to the magnetic trailing edge guide; and a storage device shaped to accommodate the magnetic trailing edge guide, wherein a length of the tether allows the magnetic trailing edge guide to reach the corner of the stack of media and to reach the storage device, and wherein the magnetic trailing edge guide includes a magnetic element adapted to magnetically hold to at least the media tray and the storage device.

9. The media stack guide according to claim 8, further comprising a bias member connected to the tether.

10. The media stack guide according to claim 9, wherein the bias member is positioned and adapted to move the tether to exert bias force on the magnetic trailing edge guide in a direction from the corner of the stack of media toward an opposing end of the stack of media, and wherein the opposing end of the stack of media is opposite the corner of the stack of media.

11. The media stack guide according to claim 9, wherein the bias member comprises a retractor adapted to draw the tether into the bias member and release the tether from the bias member to change an amount of the tether extending from the bias member.

12. The media stack guide according to claim 11, wherein the retractor comprises a motor or a spring-loaded device adapted to draw the tether into the bias member and release the tether from the bias member.

13. The media stack guide according to claim 9, wherein the bias member comprises an elastic material.

14. The media stack guide according to claim 8, wherein the tether comprises an elastic material.

15. A printing device comprising:

a frame;

a printing engine connected to the frame; and a media tray connected to the frame, wherein the media tray is adapted to hold a stack of media supplied to the printing engine for printing;

a magnetic trailing edge guide shaped to contact a corner of the stack of media;

a tether having a first end connected to the magnetic trailing edge guide and a second end connected to the frame; and a storage device connected to the frame, wherein the storage device is shaped to accommodate the magnetic trailing edge guide, wherein a length of the tether allows the magnetic trailing edge guide to reach the corner of the stack of media and to reach the storage device, wherein the media tray and the storage device comprise ferromagnetic elements, and wherein the magnetic trailing edge guide includes a magnetic element adapted to magnetically hold to at least the ferromagnetic elements of the media tray and the storage device.

16. The printing device according to claim 15, further comprising a bias member connecting the second end of the tether to the frame.

17. The printing device according to claim 16, wherein the bias member is positioned relative to the media tray to, and adapted to, move the tether to exert bias force on the magnetic trailing edge guide in a direction from the corner of the stack of media toward an opposing end of the stack of media, and wherein the opposing end of the stack of media is opposite the corner of the stack of media.

18. The printing device according to claim 16, wherein the bias member comprises a retractor adapted to draw the tether into the bias member and release the tether from the bias member to change an amount of the tether extending from the bias member.

19. The printing device according to claim 18, wherein the retractor comprises a motor or a spring-loaded device adapted to draw the tether into the bias member and release the tether from the bias member.

20. The printing device according to claim 16, wherein the tether comprises an elastic material.

* * * * *